US009518782B2

(12) United States Patent
Blomgren et al.

(10) Patent No.: US 9,518,782 B2
(45) Date of Patent: Dec. 13, 2016

(54) HEAT EXCHANGER

(75) Inventors: Fredrik Blomgren, Malmö (SE); Martin Holm, Lund (SE); Tomas Kovacs, Lund (SE)

(73) Assignee: ALFA LAVAL CORPORATED AB, Lund (SE)

( * ) Notice: Subject to any disclaimer, the term of this patent is extended or adjusted under 35 U.S.C. 154(b) by 1081 days.

(21) Appl. No.: 12/997,908

(22) PCT Filed: May 26, 2009

(86) PCT No.: PCT/SE2009/050596

§ 371 (c)(1),
(2), (4) Date: Feb. 1, 2011

(87) PCT Pub. No.: WO2009/154543

PCT Pub. Date: Dec. 23, 2009

(65) Prior Publication Data

US 2011/0139419 A1 Jun. 16, 2011

(30) Foreign Application Priority Data

Jun. 17, 2008 (SE) ..... 0801417-7

(51) Int. Cl.
*F28F 3/04* (2006.01)
*F28D 9/00* (2006.01)
*F28F 3/08* (2006.01)

(52) U.S. Cl.
CPC ..... *F28D 9/005* (2013.01); *F28F 3/046* (2013.01); *F28F 3/08* (2013.01); *F28F 3/083* (2013.01); *F28F 2215/04* (2013.01)

(58) Field of Classification Search
CPC ..... F28D 9/005; F28D 9/0037; F28F 3/046; F28F 3/048; F28F 3/083
(Continued)

(56) References Cited

U.S. PATENT DOCUMENTS 3,783,090 A * 1/1974 Andersson ..... F28F 3/083 165/166
4,434,643 A 3/1984 Almqvist et al.
(Continued)

FOREIGN PATENT DOCUMENTS

DE 3721132 C2 11/1995
EP 204880 A3 9/1987
(Continued)

OTHER PUBLICATIONS

Swedish Office Action dated Mar. 30, 2010, issued by the Swedish Patent Office in corresponding Swedish Patent Application No. 0801417-7. (6 pages).
(Continued)

*Primary Examiner* — Leonard R Leo
(74) *Attorney, Agent, or Firm* — Buchanan Ingersoll & Rooney PC

(57) ABSTRACT

The invention refers to a plate heat exchanger where the heat exchanger comprises a first flow channel between a first plate and a second plate, and where the flow channel comprises a lower distribution passage, a heat transfer passage and an upper distribution passage, where the heat transfer passage is vertically divided in a lower and an upper heat transfer passage and where the lower heat transfer passage is horizontally divided in a plurality of adjacent heat transfer zones, where the intermediate angle between the ridges and grooves in any of the heat transfer zones of the lower heat transfer passage is at least 30° larger than the intermediate angle of the ridges and grooves of the upper heat transfer passage. The advantage of the invention is that an improved heat exchanger is provided, having an increased thermal performance and an improved evaporation capacity.

12 Claims, 4 Drawing Sheets

(58) Field of Classification Search
USPC ..... 165/167
See application file for complete search history.

(56) References Cited

U.S. PATENT DOCUMENTS

| | | | | |
|---|---|---|---|---|
| 4,678,030 | A | 7/1987 | Almqvist | |
| 5,398,751 | A * | 3/1995 | Blomgren | F28F 3/046 165/167 |
| 7,168,483 | B2 | 1/2007 | Blomgren et al. | |
| 2004/0069473 | A1 | 4/2004 | Blomgren et al. | |

FOREIGN PATENT DOCUMENTS

| | | | |
|---|---|---|---|
| EP | 463298 | A1 | 1/1992 |
| EP | 0477346 | B1 | 12/1994 |
| FR | 2348460 | B1 | 9/1983 |
| JP | 4-506996 | | 3/1992 |
| JP | 10-122781 | | 5/1998 |
| SE | 466171 | C | 5/1992 |
| SE | 466871 | C | 8/1992 |
| SE | 470339 | C | 5/1994 |
| WO | WO8701795 | A1 | 3/1987 |
| WO | WO9117406 | A1 | 11/1991 |
| WO | WO9949271 | A2 | 9/1999 |
| WO | WO02053998 | A1 | 7/2002 |
| WO | WO2007004939 | A1 | 1/2007 |
| WO | 2007/142592 | | 12/2007 |

OTHER PUBLICATIONS

International Search Report for Application No. ITS/SE08/00239, dated Nov. 1, 2008, 1 page.

* cited by examiner

HEAT EXCHANGER

TECHNICAL FIELD

The present invention relates to a plate heat exchanger for evaporating a fluid.

BACKGROUND ART

The present invention relates to a plate heat exchanger for evaporating a fluid, comprising a package of abutting rectangular and essentially vertically arranged heat transfer plates, delimiting flow spaces between themselves and provided with corrugation patterns of ridges and grooves, said ridges intersectingly abutting each other in at least a part of each flow space and forming a number of supporting points between adjacent heat transfer plates, wherein each alternate flow space forms an evaporating passage, which evaporating passage has an inlet for fluid at its lower portion and an outlet for fluid and generated vapour at its upper portion near one of the vertical sides of the heat transfer plates, and the remaining flow spaces form passages for a heating fluid, which passages have inlets at their upper portions near the other vertical sides of the heat transfer plates and outlets at their lower portions.

In a known plate heat exchanger of this kind, described in DE-3721132, the main part of the heat transfer portion of each heat transfer plate has one and the same kind of corrugation pattern over its entire surface. This is ineffective with respect of the heat transfer capacity of the plate heat exchanger. In the previously known plate heat exchanger an outlet duct for fluid and generated vapour extends further through the package of heat transfer plates, which outlet duct is formed of aligned openings of the heat transfer plates. The openings are made as great as possible to minimize the flow resistance in the outlet duct for the produced vapour. In practice a large part of the upper portion of each heat transfer plate has been used for such opening. As an inlet duct, intended for the heating fluid, must also extend through the upper part of the package of heat transfer plates, it has not been possible to use the entire width of the heat transfer plates only for the outlet duct. This has resulted in flow paths of different length being formed in each evaporating passage between its inlet and its outlet for different parts of supplied fluid and vapour generated therefrom.

Owing to the known heat transfer plates having one kind of corrugation pattern over their heat transfer portions and thereby causing equal flow resistance per unit of length of each flow path for fluid and generated vapour in each evaporating passage, the total flow resistance will be largest along the longest flow path. Consequently, the smallest amount of fluid and vapour passes this path. This will lead to not all of the fluid being treated to the same heat treatment and the risk of drying out exists along the longest flow path, above all, near the inlet of the heating fluid.

EP 0 477 346 B1 describes an improved heat exchanger plate where the heat exchanger plates are divided in different zones, where the zones are provided with different corrugation patterns. In this way, the flow resistance through a fluid channel is optimized.

EP 0 458 555 B1 describes a further improved heat exchanger plate in which a lower heat transfer area is horizontally divided in different portions and upper lower heat transfer area which is vertically divided. The smallest angle for any of the portions of the lower heat transfer area has substantially the same size as any of the angles in upper heat transfer area. Thereby an even and improved flow distribution is achieved in the fluid channel from the inlet and onwards.

Even though these known heat exchanger plates show a favourable efficiency and have proved to be a commercial success, there is still room for improvements.

DISCLOSURE OF INVENTION

An object of the invention is therefore to provide an improved heat exchanger having an improved efficiency and thus an improved flow distribution. A further object of the invention is to provide a uniform quality of the discharged fluid and generated vapour.

The solution to the problem according to the invention is described in the characterizing part of claim 1. Claims 2 to 7 contain advantageous embodiments of the heat exchanger plate. Claims 8 to 12 contain advantageous embodiments of a heat exchanger.

With a heat exchanger plate for the use in a heat exchanger, where the plate comprises a lower distribution area having port holes, a heat transfer area and an upper distribution area having port holes, where the plate comprises a corrugated pattern having ridges and grooves, where the heat transfer area is vertically divided in a lower heat transfer area and an upper heat transfer area, where the lower heat transfer area is horizontally divided in a plurality of adjacent heat transfer sections, the object of the invention is achieved in that the smallest angle of the ridges and grooves of any of the heat transfer sections in the lower heat transfer area is at least 15° larger than the angle of the ridges and grooves of the upper heat transfer area.

By this first embodiment of the plate for a heat exchanger, a heat exchanger plate is obtained which allows for an optimized heat transfer and for an early evaporation of the fluid to be evaporated in the heat exchanger. This is done by having a high flow resistance in the beginning of the flow path in the heat transfer passage, i.e. in the lower heat transfer passage. In the upper heat transfer passage, the flow resistance is lower which allows the evaporated fluid to pass easily.

In an advantageous development of the inventive plate, the direction of the ridges and grooves in any of the heat transfer sections differs from an adjacent heat transfer section in the lower heat transfer area. In a further advantageous development of the inventive plate, the angle of the ridges and grooves of any of the heat transfer sections differs from an adjacent heat transfer section in the lower heat transfer area. This is advantageous in that the flow resistance in the lower heat transfer passage can be controlled over the width of the heat transfer passage. In this way, the flow distribution can be further improved by adapting the pressure drop to the length of the flow path through the flow channel. The angle of the ridges and grooves of any of the heat transfer sections are preferably in the interval between 45° and 65°. In this way, a relatively high flow resistance in the lower heat transfer passage is obtainable.

In further advantageous developments of the inventive plate, the neutral plane of the pattern in the lower distribution area is offset such that the depth of a groove compared with a neutral plane is larger than the height of a ridge compared with the neutral plane. The advantage of this is that the height of the distribution passage created between two distribution areas is reduced, which will increase the flow resistance in the passage. An increased flow resistance in the lower distribution passage will increase the back pressure in the passage, which will start the evaporation earlier in the distribution passage. This will increase the efficiency of a heat exchanger.

In further advantageous developments of the inventive plate, the neutral plane of the pattern in the upper distribution area is offset such that the height of a ridge compared with a neutral plane is larger than the depth of a groove compared with the neutral plane. The advantage of this is that the height of the distribution passage created between two distribution areas is increased, which will reduce the flow resistance in the passage. A reduced flow resistance in the upper distribution passage will allow the evaporated fluid, having a large volume, to easier conduct to the outlet port. This will increase the efficiency of a heat exchanger.

In a plate heat exchanger, where the heat exchanger comprises a first flow channel between a first plate and a second plate, where the flow channel comprises a lower distribution passage having ports, a heat transfer passage and an upper distribution passage having ports, where the heat transfer passage is vertically divided in a lower heat transfer passage and an upper heat transfer passage and where the lower heat transfer passage is horizontally divided in a plurality of adjacent heat transfer zones, the object of the invention is achieved in that the smallest intermediate angle between the ridges and grooves in any of the heat transfer zones in the lower heat transfer passage is at least 30° larger than the intermediate angle of the ridges and grooves in the upper heat transfer passage.

By this first embodiment of the heat exchanger, a heat exchanger is obtained which allows for an early evaporation of the fluid to be evaporated in the heat exchanger. This is done by having a high flow resistance in the beginning of the flow path in the heat transfer passage, i.e. in the lower heat transfer passage. In the upper heat transfer passage, the flow resistance is lower which allows the evaporated fluid to pass easily.

In an advantageous development of the inventive heat exchanger, the intermediate angle between the ridges and grooves in any of the heat transfer zones is in the interval between 90° and 130°. This angle range will give the heat transfer zones of the lower heat transfer passage sufficiently high angles in order to obtain an early evaporation. By giving at least some of the zones different angles, the flow distribution can be further optimized over the width of the plate in the horizontal direction.

In a further advantageous development of the inventive heat exchanger, the distance between the neutral plane of two adjacent distribution areas of the lower distribution passage is less than one press depth of the plate. A reduction of the distribution passage height will increase the flow resistance in the distribution passage. This will allow for an early evaporation of the fluid to be evaporated in the heat exchanger.

In a further advantageous development of the inventive heat exchanger, the distance between the neutral plane of two adjacent distribution areas of the upper distribution passage is more than one press depth of the plate. An increase of the distribution passage height will reduce the flow resistance in the distribution passage. This will facilitate the exit of evaporated fluid from the heat exchanger.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims. The expressions lower, upper, vertical and horizontal used in the description refer to positions on a heat transfer plate when in use in an assembled heat exchanger. A reference to e.g. lower will thus refer to a detail positioned at the lower portion of a heat exchanger in use.

Figure 1:
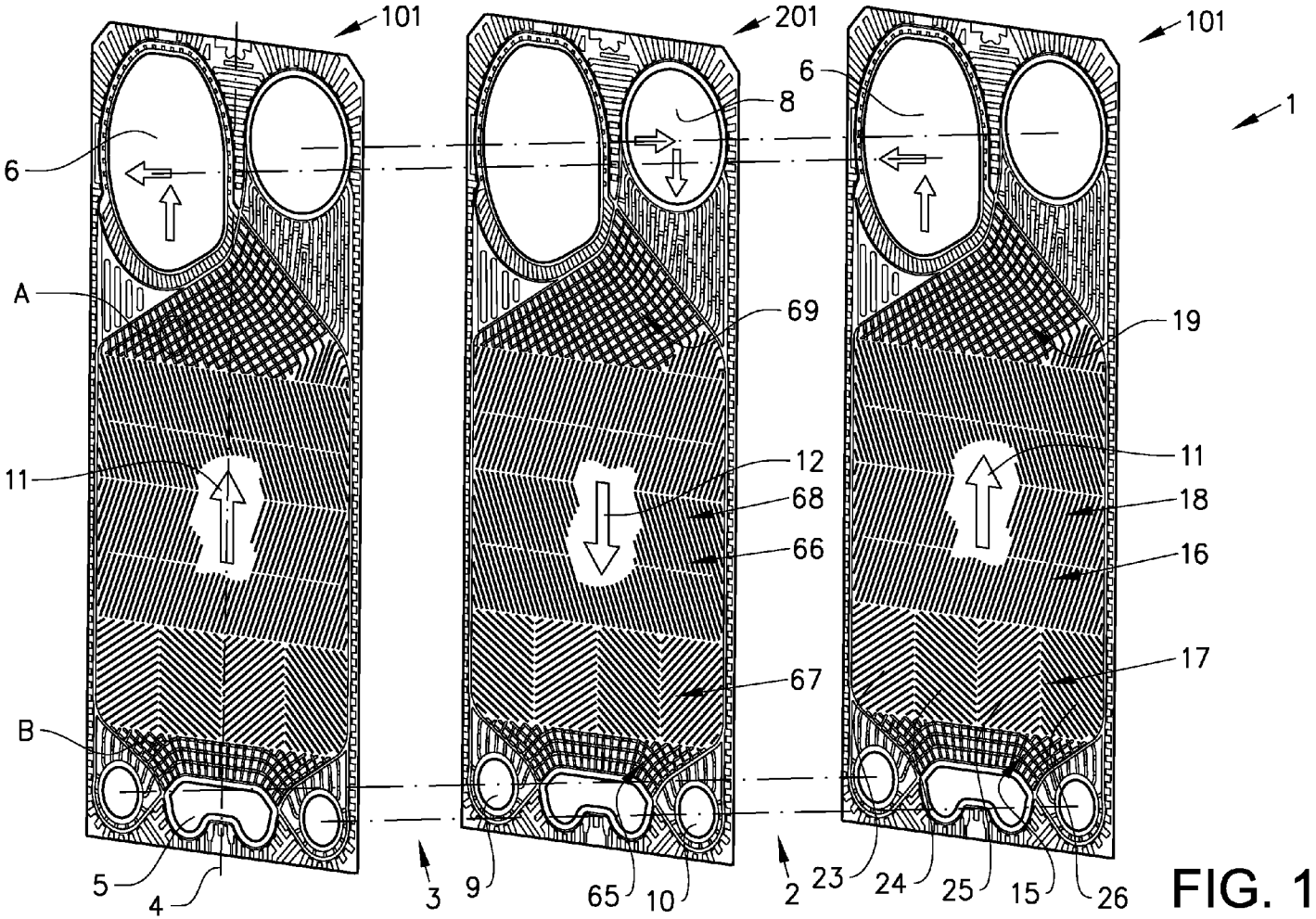
FIG. 1 shows a schematically exploded view of a plate heat exchanger assembly formed in accordance with the invention and comprising three heat transfer plates.

The plate heat exchanger assembly 1 shown in FIG. 1 comprises two types of rectangular, elongated heat transfer plates 101, 201 which have been provided with different corrugation patterns by means of pressing. The heat transfer plates, which are intended to be assembled in a frame in a conventional manner, may be provided with rubber gaskets along their edges to delimit flow channels between them, but as an alternative they could be permanently joined to each other, e.g. through soldering, welding or gluing. It is also possible to assemble two plates in a semi-welded assembly, and to assemble the semi-welded plate assemblies with gaskets. A complete heat exchanger will also include a specific front plate and back plate (not shown) having a larger thickness than the individual heat exchanger plates. The front plate and back plate will comprise connections etc.

The heat transfer plates 101 and 201 are provided with a corrugation pattern of ridges and grooves by means of pressing, the ridges of two adjacent heat transfer plates in the flow channels 3, 2 crossing and abutting each other to form a number of supporting points between the heat transfer plates. Between plate 201 and 101, an evaporation flow channel 2 is formed for the evaporation of a fluid. The flow channel 2 is provided with a fluid inlet port 5 formed by inlet port holes 205, 105 extending through a lower portion of the heat transfer plates and an outlet port 6 for fluid and generated vapour, formed by outlet port holes 206, 106 extending through an upper portion of the heat transfer plates. An arrow 11 shows the general flow direction in flow channel 2.

Between plate 101 and 201, a flow channel 3 is formed for a heating fluid or heating steam. The steam flow channel 3 is provided with a steam inlet port 8 formed by steam inlet port holes 108, 208 extending through the upper portion of the heat transfer plates, and two condensate outlet ports 9, 10 formed by condensate outlet port holes 109, 209 and 110, 210 extending through the lower portion of the heat transfer plates. An arrow 12 shows the general flow direction in flow channel 3.

The inventive heat exchanger is mainly intended for evaporation or concentration of various liquid products by means of climbing film evaporation. The long sides of the heat transfer plates 101 and 201 will be arranged vertically in an assembled heat exchanger along vertical axis 4 and fluid to be evaporated will be supplied to flow channel 2 at the lower portion and discharged at the upper portion. The heat exchanger is in this example arranged with a counter flow heat exchange where the steam as heating medium will be supplied at the upper portion of flow channel 3 and the condensate produced will be discharged at the lower portion of channel 3.

Figure 2:
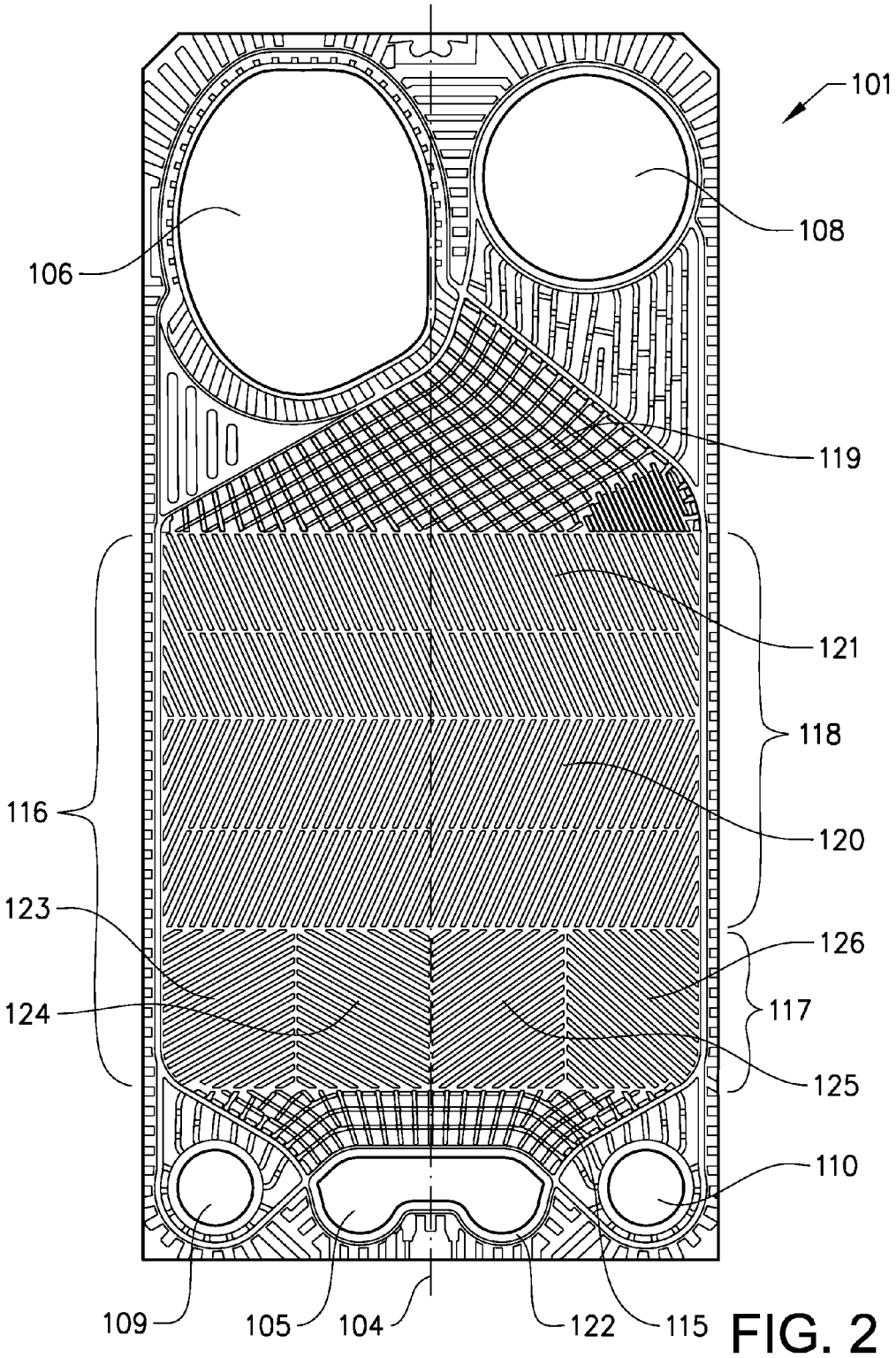
FIG. 2 shows a first heat transfer plate to be used in a plate heat exchanger according to the invention.

The first heat exchanger plate 101, shown in FIG. 2, comprises a lower distribution area 115, a heat transfer area 116 and an upper distribution area 119. The heat transfer area 116 is vertically divided in a lower heat transfer area 117 and an upper heat transfer area 118. The plate has a longitudinal or vertical axis 104. The lower distribution area 115 is provided with an inlet port hole 105 and two outlet port holes 109, 110.

It is to be understood that the complete surface of a heat exchanger plate, where there is a fluid passage on the other side of the plate, is a heat transfer area. The heat transfer area 116 is thus referred to as a heat transfer area since the main purpose is that of heat transfer, even though there will be some fluid distribution also in the heat transfer area. The lower and upper distribution areas have the dual purpose of both fluid distribution as well as heat transferral.

The upper distribution area 119 of the plate is provided with an outlet port hole 106 and a steam inlet port hole 108. The pattern of the lower and upper distribution areas exhibit in this example a bar pattern, as is further described below, even though other patterns are also possible to use. A bar pattern is advantageous in that it gives a good flow distribution of the fluid.

Figure 3:
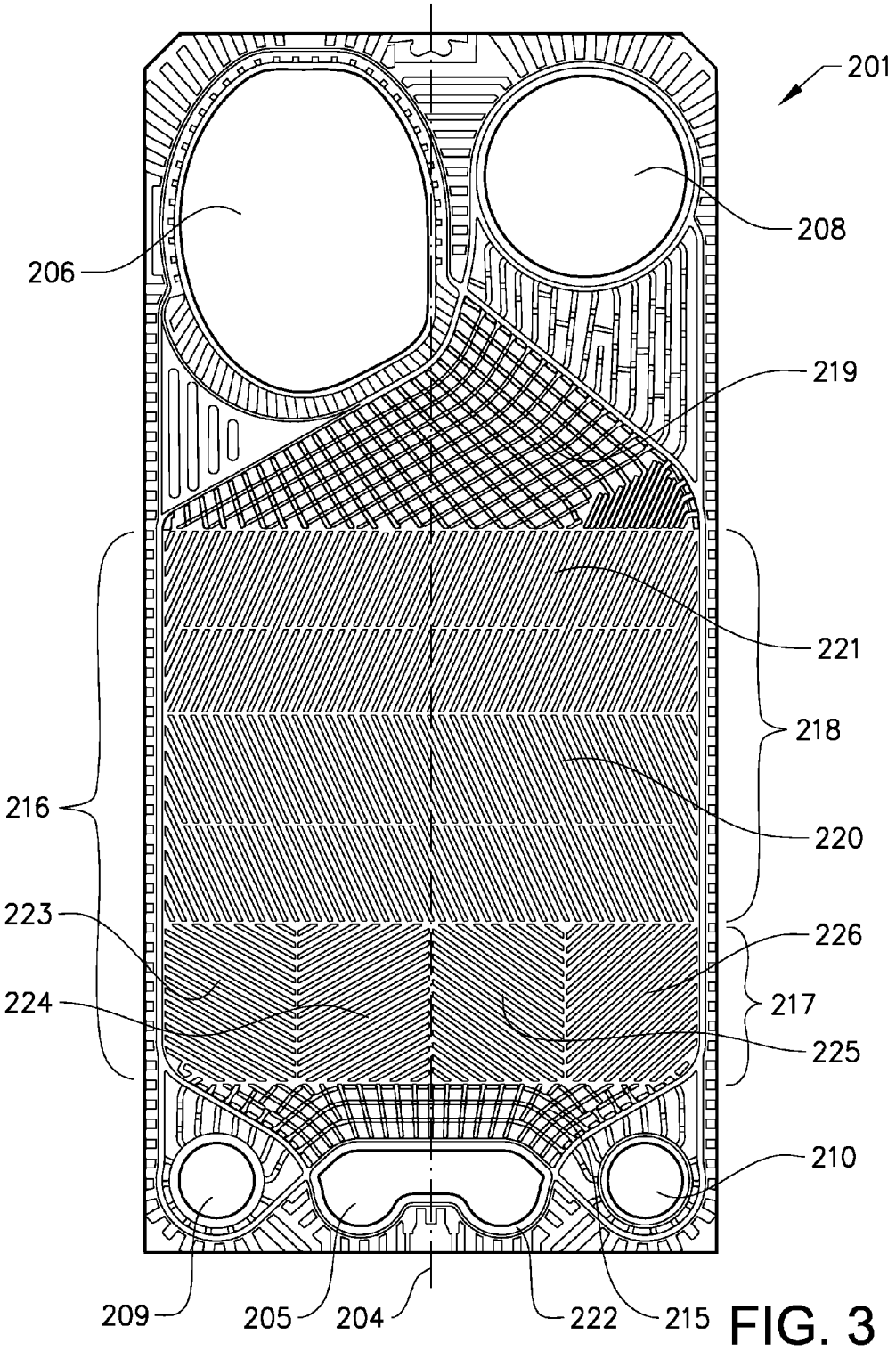
FIG. 3 shows a second heat transfer plate to be used in a plate heat exchanger according to the invention.

The second heat exchanger plate 201, shown in FIG. 3, comprises a lower distribution area 215, a heat transfer area 216 and an upper distribution area 219. The heat transfer area 216 is vertically divided in a lower heat transfer area 217 and an upper heat transfer area 118. The plate has a vertical axis 204. The lower distribution area 215 is provided with an inlet port hole 205 and two outlet port holes 209, 210.

The upper distribution area 219 of the plate is provided with an outlet port hole 206 and a steam inlet port hole 208. The pattern of the lower and upper distribution areas exhibit in this example a bar pattern, even though other patterns are also possible to use. A bar pattern is advantageous in that it gives a good distribution of the fluid.

Each of the heat transfer plates 101 and 201 thus has a lower distribution area 115, 215, a heat transfer area 116, 216 vertically divided in a lower and an upper horizontally extended area 117, 118 and 217, 218 having different corrugation patterns, and an upper distribution area 119, 219.

The first heat transfer plate 101 and the second heat transfer plate 201 are both shown in a front view in FIGS. 1 and 2. The flow channel 2 is created between the front side of the first plate 101 and the rear side of the second plate 201. The flow channel 3 is created between the front side of the second plate 201 and the rear side of the first plate 101. The references are thus to be considered to apply to both the front side and the rear side of a plate, depending on the described channel.

In the flow channels between two plates, fluid passages are created. In flow channel 2, between the lower distribution areas 215, 115, a lower distribution passage 15 is provided when the plates are assembled in a heat exchanger. Between the heat transfer areas 216, 116, a heat transfer passage 16 is provided and between the upper distribution areas 219, 119, an upper distribution passage 19 is provided when the plates are assembled in a heat exchanger. In flow channel 3, between the lower distribution areas 115, 215, a lower distribution passage 65 is provided when the plates are assembled in a heat exchanger. Between the heat transfer areas 116, 216, a heat transfer passage 66 is provided, and between the upper distribution areas 119, 219, an upper distribution passage 69 is provided when the plates are assembled in a heat exchanger. The heat transfer passage 16, created between the heat transfer areas 216, 116, is divided into a lower heat transfer passage 17, created between the lower heat transfer areas 217, 117, and an upper heat transfer passage 18, created between the upper heat transfer areas 218, 118.

The lower distribution areas 215, 115 are thus arranged to form the lower distribution passage 15. The main purpose of the lower distribution passage is to convey and distribute the fluid in channel 2 from the inlet port 5 upwards towards the heat transfer passage 16. At the same time, the lower distribution areas 115, 215 are arranged to form a lower distribution passage 65 in channel 3 to convey the condensate both vertically downwards and horizontally towards the outlet ports 9 and 10.

The lower, horizontally extended heat transfer passage 17 is created between the heat transfer areas 217, 117 and is horizontally divided into a number of heat transfer zones 23, 24, 25 and 26 being arranged adjacent to each other next to the lower distribution passage. In the shown example, adjacent zones have different corrugation patterns. The ridges and grooves in the zones 23, 24, 25 and 26 of both plates are directed in such a way that they cooperate to provide a flow resistance for the upwardly flowing fluid and generated vapour in the evaporating channel 2, which decreases from one to the other of the vertical sides of the heat transfer plates. By this, a desired distribution of the flow of fluid is achieved in the evaporating channel 2 between said vertical sides. By giving the ridges and grooves in the zones 23, 24, 25 and 26 a relatively high angle with respect to the vertical axis and thus to the main flow direction, an effective evaporation process is achieved.

The heat transfer plates 101 and 201 have punched holes at each of their ends. For channel 2, inlet port holes 205, 105 are provided at the lower end for the fluid to be evaporated and outlet port holes 206, 106 are provided at the upper end for concentrated fluid and generated vapour. For channel 3, steam inlet port holes 108, 208 are provided at the upper end for heating steam to enter the channel and two outlet port holes 109, 110, and 209, 210, respectively, are provided at the lower end for condensate and eventually uncondensed steam of the heating medium to exit.

The heat transfer plate 101 has on one of its sides a number of sealing grooves 122 which are adapted to receive a unitary gasket. The gasket extends around each of the port holes 105 and 106 and around the whole periphery of the plate. Similarly, the heat exchange plate 201 has a number of sealing grooves 222 that are adapted to accommodate a gasket extending around each of the port holes 209, 210 and 208 and around the whole periphery of the plate. The gasket grooves can, as an alternative, be formed such that two adjacent plates may be welded together having the bottom of the grooves turned against each other, wherein only alternate plate interspaces are provided with gaskets which in such a case are located in confronting grooves in the adjacent heat transfer plates. In the shown example, the gasket is arranged to seal between adjacent heat transfer plates 201 and 101 and thus to seal and define the flow channel 2. The plates 101, 201 will in the shown example be semi-welded so that flow channel 3 is sealed and defined by the welded or soldered plates.

In the horizontally extended heat transfer areas 117, 118 and 217, 218, respectively, the ridges and grooves incline differently against the intended main flow direction of the fluid. Fluid which is to be completely or partly evaporated is supplied into the plate heat exchanger through the fluid inlet port 5 which is located in the lower part of the heat exchanger, and the fluid then flows upwards through channel 2. Fluid is evenly distributed across the width of the heat transfer plates by the lower distribution passage 15 created between the lower distribution areas 215 and 115. In the heat transfer passage 16 between the heat transfer areas 216 and 116, the fluid first passes the areas 217 and 117, which include the four sections 223, 224, 225, 226 and 123, 124, 125, 126, respectively.

The sections 223 and 123, located at one vertical side of the plate, have a corrugation pattern with a high pattern angle which provides a relatively great flow resistance in the evaporation channel 2 for upwardly flowing fluid, i.e. the ridges of the plates cross each other with a comparatively large intervening angle directed against the flow direction of the fluid. The angle of the pattern, i.e. the ridges and grooves, is measured with relation to the vertical axis in a clockwise or counter-clockwise direction. Thus, the heat transfer between the plates and the fluid becomes relatively efficient and consequently, vapour is generated relatively soon in these portions of the channel 2. In the shown example, the ridges and grooves of section 223 has an angle of 60° relative the vertical axis measured in a counter-clockwise direction. The ridges and grooves of section 123 are similar but mirror-inverted.

The sections 224 and 124, located next to sections 223 and 123 in the horizontal direction, have a corrugation pattern with a different direction than sections 223, 123, but with the same angle. This angle also provides a relatively great flow resistance in the evaporation channel 2 for the upwardly flowing fluid. Thus, the heat transfer between the plates and the fluid becomes relatively efficient and consequently, vapour is generated relatively soon in these portions of the channel 2. In the shown example, the ridges and grooves of section 224 has an angle of 60° relative the vertical axis measured in a clockwise direction. The ridges and grooves of section 124 are similar but mirror-inverted.

The sections 225 and 125, located next to sections 224 and 124 in the horizontal direction, have a corrugation pattern with a different direction and angle than sections 224, 124. The angle of sections 225, 125 is here somewhat smaller than the angle of sections 223, 123, and 224, 124. This angle will still provide a high flow resistance but it will be reduced somewhat compared with the flow resistance achieved between sections 223, 123 and 224, 124 in the evaporation channel 2 for the upwardly flowing fluid. In the shown example, the ridges and grooves of section 225 has an angle of 54° relative the vertical axis measured in a counter-clockwise direction. The ridges and grooves of section 125 are similar but mirror-inverted.

The sections 226 and 126, located next to sections 225 and 125 in the horizontal direction, have a corrugation pattern with a different direction and angle than sections 225, 125. The angle of sections 226, 126 is somewhat smaller than the angle of sections 225, 125. This angle will still provide a high flow resistance but it will be reduced somewhat compared with the flow resistance achieved between sections 225, 125 in the evaporation channel 2 for the upwardly flowing fluid. In the shown example, the ridges and grooves of section 226 has an angle of 48° relative the vertical axis measured in a clockwise direction. The ridges and grooves of section 126 are similar but mirror-inverted.

In the heat transfer zones 23-26, created between heat transfer sections 223-226 and 123-126, respectively, the ridges and grooves thus incline differently against the intended main flow direction of the fluid as described above. As a result, the intermediate angle for the intersecting ridges and grooves of the plates 201 and 101 will be 120° in the zones 23 and 24, 108° in zone 25 and 96° in zone 26.

In zones 23 and 24, the flow resistance in the passage 17 will be the highest. The flow resistance will decrease somewhat in zone 25 and somewhat more in zone 26. In this way, the flow distribution of the fluid is optimised since the flow path of the fluid flowing through zones 23 and 24 is somewhat shorter than the fluid flowing through e.g. zone 26.

In the upper heat transfer areas 218, 118, the angle of the ridges and grooves is much smaller. Between the heat transfer areas 218, 118, an upper heat transfer passage 18 having a relatively low flow resistance is created. In the shown example, the upper heat transfer areas 218, 118 are divided in two areas, a first heat transfer area 220, 120 and a second heat transfer area 221, 121. The angel of the ridges and grooves in the first and the second heat transfer area is the same, but the direction is different. The angle will thus be measured in a clockwise or counter-clockwise direction, depending on the heat transfer area. It is also possible to let the complete upper heat transfer area have the same angle over the complete surface.

In the shown example, the angle of the ridges and grooves of the heat transfer area 218 is 24°. The ridges and grooves of area 128 are similar but mirror-inverted. The intermediate angle for the intersecting ridges and grooves of the plates 201 and 101 will thus be 48° for the upper heat transfer passage 18.

The values given for these angles have been chosen with reference to a certain heat exchange task for the present heat exchanger. Other values can of course be chosen for other heat exchange tasks. The angles for the sections of the lower heat transfer areas 217, 117 are preferably in the range between 45°-65°. The angles for the upper heat transfer areas 218, 118 are preferably in the range between 20°-30°. The difference between the smallest angle of the areas 217, 117 and the areas 218, 118 are preferably larger than 15°. This angle difference will give a good balance between the flow resistance in passage 17 and the flow resistance in passage 18 and will help to give an early start of the evaporation process and at the same time allow the evaporated fluid to pass the upper heat transfer passage easily.

The advantage of giving the ridges and grooves a relatively large angle in the lower heat transfer passage 17 is that the flow resistance will be relatively high. This will allow the evaporation to start early in the heat transfer passage, i.e. in the lower part of the heat transfer passage, which in turn will make the evaporation and the heat transfer more efficient in the heat exchanger. The angle of the ridges and grooves in the upper heat transfer passage 18 is given a relatively small value. This will provide a low flow resistance which will give a low pressure drop in the passage. Since the fluid is more or less evaporated in this passage, the volume of the fluid will be much larger and a low flow resistance is thus of advantage.

From the lower heat transfer passage 17, fluid and generated vapour continue upwards in the evaporating channel through the upper heat transfer passage 18. The flow resistance for the fluid and generated vapour decreases from one vertical side to the other in the lower heat transfer passage 17. The flow resistance also decreases along the flow direction of the fluid in the heat transfer passages 17 and 18. Fluid and generated vapour then continue to the upper distribution passage 19, created between the upper distribution areas 219, 119, and further through the outlet port 6.

In the channel 3 for the heating medium, the flow takes place in the opposite direction. Steam is here supplied through the steam inlet port 8 and is in channel 3 subjected to an increasing flow resistance along the flow path. In the shown example, two condensate outlets 9, 10 are shown, but it is also possible to only use one.

When the steam has entered channel 3 through inlet port 8, the steam is carried through an intermediate distribution passage to the upper distribution passage 69 created between the upper distribution areas 119, 219, where the steam is evenly distributed over the width of the passage. The condensation of the steam also starts in the upper distribution passage. The steam and condensate then enters the heat transfer passage 66, in which the main part of the condensation takes place. The heat transfer passage 66 comprises an upper heat transfer passage 68 and a lower heat transfer passage 67. The upper heat transfer passage 68 is created between the heat transfer areas 118, 218 and the lower heat transfer passage is created between the heat transfer areas 117, 217. In this example, the heat transfer areas 118, 218 are divided into a first heat transfer area 120, 220, and a second heat transfer area 121, 221. Since the angles of the ridges and grooves in the upper heat transfer passage 68 are relatively small, the flow resistance in the upper heat transfer passage will be relatively low. This allows the uncondensed steam to move rather easy through the upper heat transfer passage. The angles of the ridges and grooves in the lower heat transfer passage 67 are relatively large, such that a higher flow resistance is obtained.

Since the flow resistance in the lower heat transfer passage 67, created between the lower heat transfer areas 117, 217, is relatively high due to the large angles of the ridges and grooves, the heat transfer in channel 3 will be improved somewhat. The fact that the flow resistance varies somewhat in the horizontal direction of the heat transfer passage 67 will not affect the flow in channel 3 to any greater extent, since the main part or all of the supplied steam has condensed before the fluid enters passage 67. The flow resistance in the lower heat transfer passage 67 will also not effect the distribution of steam in the upper heat transfer passage 68 to any essential extent.

In order to increase the efficiency of the heat exchanger further, the pressure drop in the distribution passages of the flow channel 2, i.e. the evaporation channel, may be controlled such that the pressure drop in the lower distribution passage 15 is increased and the pressure drop in the upper distribution passage 19 is reduced. The pressure drop in the distribution passages is controlled by altering the press depth of the neutral plane in the distribution areas 215, 115 of the heat transfer plates 201, 101.

Figure 4:
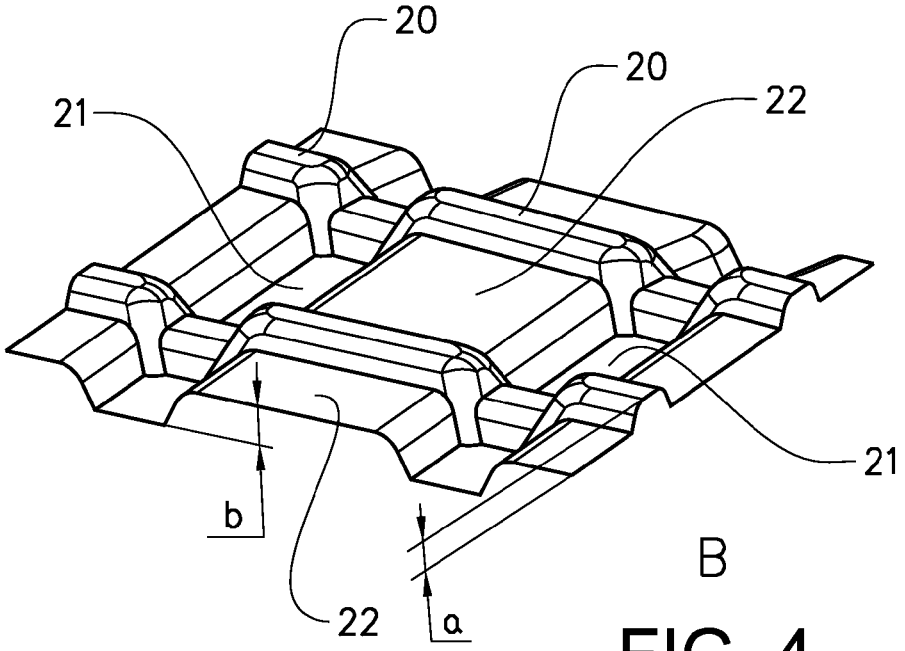
FIG. 4 shows a detail of a lower distribution area of a heat transfer plate according to the invention.

When the flow resistance in the distribution passage 15 is increased, the evaporation of the fluid will start earlier in the passage which will increase the efficiency of the heat exchanger. FIG. 4 shows a view of the distribution pattern of a lower distribution area. The pattern comprises ridges 20, grooves 21 and a neutral plane 22. The height of a ridge over the neutral plane is denoted a, and the depth of a groove from the neutral plane is denoted b. The height from a groove to a ridge, i.e. a+b, is the press depth of the plate.

In the distribution pattern of a conventional heat transfer plate, having the same type of distribution pattern, the measures a and b are normally the same. In the lower distribution area of the inventive heat transfer plate, this relation is altered in order to control the flow resistance. Thus, the measure b is larger than measure a, i.e. a groove is deeper than the height of a ridge. When two plates are mounted next to each other such that a distribution passage is created between them, the ridges 20 of two adjacent areas will bear on each other. This means that the distance between two neutral planes will be a+a, and since the measure a is reduced, the height of the passage will be less than one press depth. Since the ridges are positioned in parallel with the main flow direction, the main part of the fluid will flow through this passage between the ridges. The flow resistance through the distribution passage 15 will thus be increased.

The offset of the height position of the neutral plane, which corresponds to the height of a ridge, is advantageously in the region of 30-80%. This means that the height of a ridge in the lower distribution area will be 0.3 to 0.8 of half the press depth of the plate. Accordingly, the measure b follows in an inverted way, such that the depth of a groove will be 1.7 to 1.2 of half the press depth.

At the same time, the flow resistance in distribution passage 65 in channel 3 will be somewhat reduced. Since the flow direction in distribution passage 65 is directed towards the outlet ports 9 and 10, the flow direction will be more or less parallel with the grooves. The distance between the neutral planes will here be b+b, i.e. more than one press depth, and the flow resistance will thus be somewhat reduced. In the distribution passage 65, the grooves of the distribution areas will bear on each other.

Figure 5:
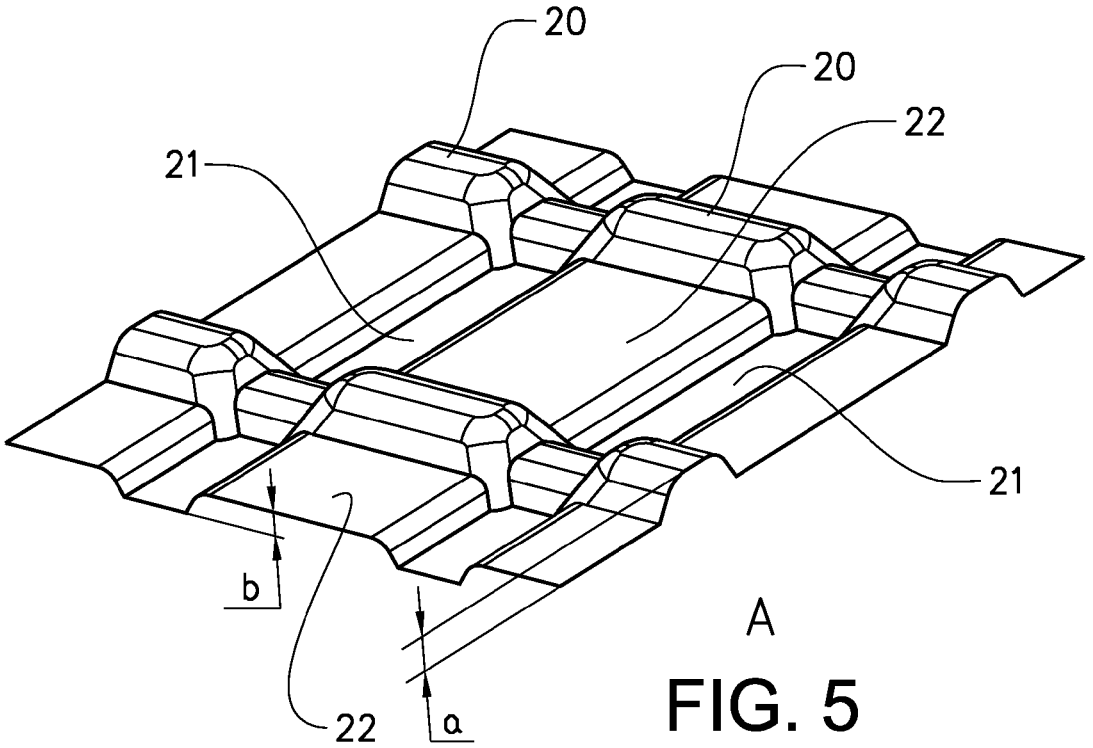
FIG. 5 shows a detail of an upper distribution area of a heat transfer plate according to the invention.

In the upper distribution passage 19, the flow resistance is somewhat reduced. Since most or all of the fluid will be evaporated in the upper distribution passage, the flow of the vapour, having a large volume, will be facilitated. This will also increase the efficiency of the heat exchanger. FIG. 5 shows a view of the distribution pattern of an upper distribution area.

The pattern comprises ridges 20, grooves 21 and a neutral plane 22. The height of a ridge over the neutral plane is denoted a, and the depth of a groove from the neutral plane is denoted b. The height from a groove to a ridge, i.e. a+b, is the press depth of the plate.

In the upper distribution area, the height of the ridges from the neutral plane is increased somewhat so that the measure a is larger than measure b, i.e. the height of a ridge is larger than the depth of a groove. When two plates are mounted next to each other such that a distribution passage is created between them, the ridges 20 of two adjacent areas will bear on each other. This means that the distance between two neutral planes will be a+a, and since a is increased, the height of the passage will be more than one press depth. The flow direction in the upper distribution passage will be mainly parallel with the ridges of the distribution pattern. The flow resistance through the distribution passage 19 will thus be reduced.

The offset of the height position of the neutral plane, which corresponds to the height of a ridge, is advantageously in the region of 170-120% for the upper distribution area. This means that the height of a ridge in the upper distribution area will be 1.7 to 1.2 of half the press depth of the plate. Accordingly, the measure b follows in an inverted way, such that the depth of a groove will be 0.3 to 0.8 of half the press depth.

The flow resistance in the upper distribution passage 69 in flow channel 3 will at the same time increase somewhat. The flow direction in distribution passage 69 is directed from inlet port 8 to the heat transfer passage 66, which means that the flow will be mainly parallel with the grooves of the pattern. The distance between the neutral planes in the passage is b+b, and since measure b is reduced, the flow resistance will be somewhat increased. In the distribution passage 69, the grooves of the distribution areas will bear on each other.

The flow resistance in the lower distribution passage may be altered alone or in combination with the upper distribution passage. The flow resistance achieved must of course be adapted to the pressure drop in a complete installed system.

In the embodiment of the invention shown in the drawings, both of the heat transfer plates 201 and 101 create, when mounted in a heat exchanger, a lower heat transfer passage 17 and an upper heat transfer passage 18 with different corrugation patterns and several different heat transfer zones in passage 17. However, it should be possible to obtain the aimed effect of the invention even if only one heat transfer plate is divided in this way, while the other heat transfer plate had the same corrugation pattern over the entire heat transfer area. In addition, the different areas 217-218 and 117-118 of the plates, and the different sections 223-226 and 123-126 of the lower heat transfer area, have been shown located directly opposite to each other, but as an alternative they could be located so that they only partly overlap each other. Also the number and the size of the areas and sections could of course vary.

By the invention, an improved plate heat exchanger can be obtained, which shows a considerable improvement in the overall thermal performance of the heat exchanger. This is mainly due to the increased flow resistance in the lower part of the heat transfer passage of the evaporation channel. The invention is not to be regarded as being limited to the embodiments described above, a number of additional variants and modifications being possible within the scope of the subsequent patent claims.

REFERENCE SIGNS

1: Heat transfer plate assembly
2: Flow channel
3: Flow channel
4: Vertical axis
5: Fluid inlet port
6: Outlet port
8: Steam inlet port
9: Condensate outlet port
10: Condensate outlet port
11: Flow direction
12: Flow direction
15: Lower distribution passage
16: Heat transfer passage
17: Lower heat transfer passage
18: Upper heat transfer passage
19: Upper distribution passage
20: Ridge
21: Groove
22: Neutral plane
23: First heat transfer zone
24: Second heat transfer zone
25: Third heat transfer zone
26: Fourth heat transfer zone
65: Lower distribution passage
66: Heat transfer passage
67: Lower heat transfer passage
68: Upper transfer passage
69: Upper distribution passage
101: Heat transfer plate
104: Vertical axis
105: Fluid inlet port hole
106: Outlet port hole
108: Steam inlet port hole
109: Condensate outlet port hole
110: Condensate outlet port hole
115: Lower distribution area
116: Heat transfer area
117: Lower heat transfer area
118: Upper heat transfer area
119: Upper distribution area
120: First heat transfer area
121: Second heat transfer area
122: Sealing groove
123: First heat transfer section
124: Second heat transfer section
125: Third heat transfer section
126: Fourth heat transfer section
201: Heat transfer plate
204: Vertical axis
205: Fluid inlet port hole
206: Outlet port hole
208: Steam inlet port hole
209: Condensate outlet port hole
210: Condensate outlet port hole
215: Lower distribution area
216: Heat transfer area
217: Lower heat transfer area
218: Upper heat transfer area
219: Upper distribution area
220: First heat transfer area
221: Second heat transfer area
222: Sealing groove
223: First heat transfer section
224: Second heat transfer section
225: Third heat transfer section
226: Fourth heat transfer section

What is claimed is:

1. A heat exchanger plate for use in a heat exchanger, the heat exchanger plate comprising:

a lower distribution area including port holes;

a heat transfer area;

an upper distribution area including port holes;

a corrugated pattern of ridges and grooves in the heat transfer area, the ridges and grooves in the corrugated pattern being oriented at an angle measured with relation to a vertical axis of the heat exchanger plate;

wherein the heat transfer area is vertically divided into a lower heat transfer area and an upper heat transfer area;

wherein the lower heat transfer area is horizontally divided into a plurality of adjacent heat transfer sections wherein the smallest angle of the ridges and grooves amongst all of the heat transfer sections in the lower heat transfer area is at least 15° larger than the angle of the ridges and grooves of the upper heat transfer area;

the plate including a plurality of spaced apart surface portions in the lower distribution area, each surface portion in the lower distribution area being bounded by two adjacent ridges in the lower distribution area and two adjacent grooves in the lower distribution area, the entirety of each of the surface portions lying in a common neutral plane;

wherein the depth of each of a plurality of the grooves in the lower distribution area compared with the neutral plane is larger than the height of each of a plurality of the ridges in the lower distribution area compared with the neutral plane; and wherein the direction of the ridges and grooves in each of the heat transfer sections differs from an adjacent heat transfer section in the lower heat transfer area.

2. The plate according to claim 1, wherein the angle of the ridges and grooves of each of the heat transfer sections differs from an adjacent heat transfer section in the lower heat transfer area.

3. The plate according to claim 1, wherein the angle of the ridges and grooves of each of the heat transfer sections is in the interval between 45° and 65°.

4. The plate according to claim 1, wherein the upper heat transfer area is vertically divided in a plurality of horizontally extending heat transfer areas having a pattern with different angles and/or directions.

5. A plate heat exchanger, comprising a plurality of heat transfer plates according to claim 1, and further comprising a front plate and a back plate.

6. The plate heat exchanger according to claim 5, wherein the heat exchanger comprises a first flow channel between a first plate and a second plate, where the flow channel comprises a lower distribution passage having ports, a heat transfer passage and an upper distribution passage having ports, where the heat transfer passage is vertically divided in a lower heat transfer passage and an upper heat transfer passage and where the lower heat transfer passage is horizontally divided into a plurality of adjacent heat transfer zones wherein, the smallest intermediate angle between the ridges and grooves amongst all of the heat transfer zones in the lower heat transfer passage is at least 30° larger than the intermediate angle of the ridges and grooves in the upper heat transfer passage.

7. The plate heat exchanger according to claim 6, wherein the intermediate angle between the ridges and grooves in each of the heat transfer zones is in the interval between 90° and 130°.

8. The plate heat exchanger according to claim 6, wherein the distance between the neutral plane of two adjacent distribution areas of the lower distribution passage is less than one press depth of the plate.

9. The plate heat exchanger according to claim 6, wherein the distance between the neutral plane of two adjacent distribution areas of the upper distribution passage is more than one press depth of the plate.

10. The heat exchanger plate according to claim 1, further including a plurality of spaced apart surface portions in the upper distribution area, each surface portion in the upper distribution area being bounded by two adjacent ridges in the upper distribution area and two adjacent grooves in the upper distribution area, the entirety of each of the surface portions in the upper distribution area lying in a common neutral plane, the height of each of a plurality of the ridges in the upper distribution area compared with the neutral plane in the upper distribution area is greater than the depth of each of a plurality of the grooves in the upper distribution area compared with the neutral plane in the upper distribution area.

11. A heat exchanger plate for use in a heat exchanger, the heat exchanger plate comprising:

a lower distribution area including port holes;

a heat transfer area;

an upper distribution area including port holes;

a corrugated pattern of ridges and grooves, the ridges and grooves in the corrugated pattern being oriented at an angle measured with relation to a vertical axis of the heat exchanger plate;

wherein the heat transfer area is vertically divided into a lower heat transfer area and an upper heat transfer area;

wherein the lower heat transfer area is horizontally divided into a plurality of adjacent heat transfer sections wherein the smallest angle of the ridges and grooves amongst all of the heat transfer sections in the lower heat transfer area is at least 15° larger than the angle of the ridges and grooves of the upper heat transfer area;

the plate including a plurality of spaced apart surface portions in the upper distribution area, each surface portion in the upper distribution area being bounded by two adjacent ridges in the upper distribution area and two adjacent grooves in the upper distribution area, the entirety of each of the surface portions lying in a common neutral plane;

wherein the height of each of a plurality of the ridges in the upper distribution area compared with the neutral plane is larger than the depth of each of a plurality of the grooves in the upper distribution area compared with the neutral plane in the upper distribution area; and wherein the direction of the ridges and grooves in each of the heat transfer sections differs from an adjacent heat transfer section in the lower heat transfer area.

12. The heat exchanger plate according to claim 11, further including a plurality of spaced apart surface portions in the lower distribution area, each surface portion in the lower distribution area being bounded by two adjacent ridges in the lower distribution area and two adjacent grooves in the lower distribution area, the entirety of each of the surface portions in the lower distribution area lying in a common neutral plane, the depth of each of a plurality of the groves in the lower distribution area compared with the neutral plane in the lower distribution area is greater than the height of each of a plurality of the ridges in the lower distribution area compared with the neutral plane in the lower distribution area.

* * * * *